United States Patent [19]

Kent

[11] Patent Number: 4,610,919

[45] Date of Patent: Sep. 9, 1986

[54] BINDER FOR FIBROUS PADDING

[75] Inventor: James Kent, La Porte, Ind.

[73] Assignee: Fiber Bond Corporation, Michigan City, Ind.

[21] Appl. No.: 744,773

[22] Filed: Jun. 14, 1985

[51] Int. Cl.[4] ..... B32B 15/14; B32B 27/04

[52] U.S. Cl. ..... 428/285; 427/421; 428/287; 428/288; 428/290; 524/513; 524/514

[58] Field of Search ..... 428/288, 290, 285, 287; 524/513, 514, 904; 525/165, 183

[56] References Cited

U.S. PATENT DOCUMENTS 4,119,600 10/1978 Bakule et al. ..... 524/514 X 4,442,247 4/1984 Ishikura et al. ..... 524/513 X

*Primary Examiner*—Theodore E. Pertilla

*Attorney, Agent, or Firm*—Charles F. Pigott, Jr.

[57] ABSTRACT

Fibrous padding in which the fibers are held together by a binder. The binder comprises a mixture of (a) an R.F. sealable dried residue of a thermoplastic latex emulsion, and (b) an R.F. sealable plastic powder of polyester, polyamide, or mixtures thereof which melt in a narrower temperature range than the latex emulsion residue. Such fibrous padding is capable of R.F. sealing with better adhesion to loose weave knit fabrics which are uncoated with adhesive, and the resulting bond exhibits improved heat stability.

13 Claims, No Drawings

BINDER FOR FIBROUS PADDING

BACKGROUND OF THE INVENTION

Heat sealable, non-woven padding has been used particularly in automobile manufacture. Particularly in the side or door panels, sun visors, and other areas of decorative fabric is laid over a thickness of non-woven padding which carries a thermoplastic binder. The non-woven padding, in turn, may be placed on a backing of cardboard or the like. When, a dielectric or radio frequency (R.F.) sealing apparatus may be used to place seal lines into the stack of fabric padding and backing, so that the fabric bulges out in areas between the seal lines in a resilient and decorative manner.

For example, the latex-bonded, non-woven paddings which are Product Numbers 147a or 6131-x of the Fiber Bond Corporation of Michigan City, Ind. They are illustrative of a type of padding which has been sold to the auto industry for several years for the purpose described above. A vinyl latex binder is applied to non-woven padding, which padding is produced by an air-laid, garnet or carding process. The latex emulsion is applied to a fibrous web which is so produced by a spraying or saturation method. The web is then dried to remove water, and heated to fuse the latex, resulting in a fibrous pad which can adhere to many fabrics and to cardboard backing upon R.F. sealing.

One deficiency of non-woven padding, and their binders, of the prior art is that the adhesion upon heat sealing of such padding to knitted or other loose weave fabrics which are not coated with a binder leaves something to be desired. The high temperature flow characteristics of such vinyl binders is not very high, so that adhesion to such loose weave fabrics by mechanical entrapment of the fibers in the fabric is not very good. Thus when the prior art non-woven padding is R.F. sealed to such fabrics at typical bonding temperatures of 275°–325° F., they lack low melt viscosities, and do not form a strong mechanical bond with the fabrics. Their bonding capabilities are based more upon physical interaction on the molecular level with the materials of fabrics or binders in the fabrics, so that the prior art pads do adhere well for example to supported vinyl fabric or to woven fabric with latex adhesive on the back, but not well to uncoated knit fabrics and the like.

Also, the non-woven padding with latex binders exhibits certain difficulties in meeting certain environmental heat aging tests, because the vinyl polymer will soften and creep under stress to a point to where bond failures can occur, for example, at temperatures of 85°–93° C. Latex polymers that are formulated to give better bonding with uncoated, loose-weave fabrics, may rapidly lose their strength and fail cohesively at elevated test conditions of 85° C. and the like. Conversely, if a latex polymer is used which does not soften appreciably at 85°–93° C., it will not melt sufficiently at practical bonding temperatures used in R.F. sealing to produce good mechanical bonds for good mechanical adhesion to uncoated fabrics.

Additionally, the Sackner Company, a subsidiary of Bemis Manufacturing Company of Grand Rapids, Mich., sells a product Number 151a, which is a composite pad. Lines of thermoplastic polyamide or polyester powder are laid on fibrous pads and fused. Following this, the lines of fused powder can be used in R.F. sealing to fabric.

Such a product is undesirably expensive due to the need to apply the polyamide or polyester powder in lines across the face of padding and then to fuse it. Thereafter the plastic lines must be fused once again by R.F. sealing, for example, for bonding to fabric and the like. As a further disadvantage besides cost, the fused polyamide or polyester can break off as the pad is handled so that portions fall off of the pad. Likewise fused powder will fall off of the pad as well, which will result in the inconvenience of undesirable powder flying around, and a possible loss of bonding capabilities due to loss of material from the fused lines.

Accordingly, there is a need for an improved binder for fibrous padding which can be inexpensive, yet which can provide reliable, effective bonding to a larger variety of fabrics than the latex bonded pads of the prior art, so that the auto industry and other groups can make use of padding manufactured in accordance with this invention with a wide and varying selection of fabrics, without concern that there will be a bonding failure in the final product.

DESCRIPTION OF THE INVENTION

In this invention, fibrous padding made of thermoplastic fibers is held together by a binder. In accordance with this invention, the binder comprises a mixture of (a) 25 to 100 parts by weight of an R.F. sealable dried residue of a thermoplastic latex emulsion; and (b) 25 to 100 parts by weight of an R.F. sealable thermoplastic powder selected from the group consisting of polyesters and polyamides which melt in a narrower temperature range than the latex emulsion residue. Typically, the R.F. sealable thermoplastic powders have greater crystallinity than the latex emulsion residue material. This provides a sharper melting point to polyesters and polyamides, which melting point is preferably at R.F. sealing temperatures of about 275°–350° F. Thus, the addition of such thermoplastic powder to the conventional latex emulsion of a binder provides a binder having improved melt flow characteristics which render the mechanical bonding of uncoated and loose weave fabrics more effective. In fact, it is found that up to an 80% increase in bonding strength can be provided by the invention of this application when uncoated, loose weave fabrics are bonded to fibrous padding made in accordance with this invention.

At the same time, as a further advantage, since the R.F. sealable thermoplastic powder is mixed with the latex emulsion residue binder, the powder is secured to the fibrous padding, and is not lost from the padding by rough handling prior to the heat bonding step.

It is to be understood that the fibrous padding of the invention may be heat bonded to fabric by techniques other than R.F. sealing, although R.F. sealing is preferred.

Preferably the particle size range of the thermoplastic powders used herein is no more than 80 microns. Particle sizes up to 500 microns can be applied to the web by spraying or saturation, but the texture of the padding becomes less desirable and poorer binder penetration into the fibrous web will result if the binder is applied by spraying.

It is to be understood that the term "residue of a thermoplastic latex emulsion" refers to the fact that upon application the residue was part of a latex emulsion, but the solvent vehicle, typically water, has been driven off by evaporation so that the former latex emulsion has coalesced into a dried residue.

Typically, the binder in its original form contains a substantial amount of water in which the latex emulsion is dispersed. The latex emulsion may be made of a large variety of thermoplastic materials, typically primarily selected from the group of polymers made from the monomers vinyl chloride, vinylidene chloride, vinyl acetate, ethylene, acrylic and methacrylic esters, and styrene. Copolymers are commonly made from these monomers and include polyvinylchloride-acrylate, polyvinylchloride-acetate, polyvinylidene chloride-acrylate, polyethylene-vinyl chloride, polyethylene-vinyl acetate, polyacrylate-styrene, and polyvinylacetate-acrylate. Other polymers and polymer units may be added in small amounts so as not to fundamentally change the characteristic of the thermoplastic latex emulsion of this invention. Sufficient polar materials must be present in the latex emulsion residue to permit R.F. sealing, although nonpolar materials such as polyethylene may be present.

For example, polymers and polymer units may be added to the latex emulsion including polymer moieties obtained from the following functional monomers: acrylamide, methylolacrylamide, methacrylamide, 2-aminoethyl vinyl ether, glycidyl methacrylate, hydroxyethyl methacrylate, hydroxypropyl methacrylate, or unsaturated carboxylic acids such as acrylic, methacrylic, and itaconic. These materials, being reactive, can enhance adhesion and modify the thermoplastic nature of polymers used herein by providing crosslinking opportunities and the like preferably to cause the latex emulsion residue to be self-crosslinking at 275°-350° F. Materials which have self-crosslinking characteristics are commercially available.

Preferably the dry latex emulsion residue used herein may consist essentially of a mixture of at least 6 weight percent of polyvinylchloride latex emulsion residue and preferably 17-230 parts by dry weight of polyvinylchlorideacrylate to 100 parts by dry weight of styrenated acrylic self-crosslinking latex residue. The polyvinyl chlorideacrylate may provide adhesion advantages for causing the bonded pad of this invention to bond in satisfactory manner to polyvinyl chloride fabric, for example. Also, it can impart flame resistance to the padding, particularly when a flame retardant material such as antimony trioxide or pentoxide is present in an amount sufficient to retard flammability. Specifically, about 2 to 4% by weight of total binder solids of this invention may comprise antimony trioxide.

Preferably, about 60 to 240 parts of dry ingredient (a) are present per 100 parts by dry weight of ingredient (b).

Ingredient (b) may be, for exaple, a thermoplastic powder of a polyamide reaction product of caprolactam, hexamethylenediamine adipate, and lauryl lactam. Such copolyamides are solde by Emser Industries, a division of EMS-American Grilon, Inc., under the name Griltex. Additionally, linear polyesters or copolyesters may be used. For example, Emser Industries manufactures Griltex 6P and 8P which are copolyesters, and Bostik 7178 is a linear polyester manufactured by Emhart Chemical Corp.

Typically, the binder of this invention in solution form contains from 30 to 60 weight percent of total solids in a primarily aqueous base. The plastic powders of ingredient (b) may be uniformly dispersed in such aqueous mixture.

A non-woven fibrous web of polyester fibers may be produced with conventional web producing devices such as card, garnet, or airlaid machines. The airlaid Rando Webber machine is one preferred machine which can produce a web of uniform, randomly distributed, crimped, staple fibers. The fibrous web made of crimped, staple fiber may typically have deniers of 1.25 to 50 and cut lengths of 0.5 to 3 inches. For example, a blend of 6 and 15 denier polyester fibers in cut lengths of 1½ to 2 inches may be used in a ratio of 60% by weight of 15 denier polyester and 40% by weight of 6 denier polyester. For this product, the fiber weight can be between 2 and 10 oz. per square yard of padding with a dry binder weight in the padding of 1 to 3 times that of the fiber weight. A practical and functional fiber weight of 3.5 oz. per square yard plus or minus 10% and a dry binder weight of 7.0 oz. per square yard plus or minus 10% was found most suitable for a door panel application. The thickness of the web so produced may be adjusted to 0.5 plus or minus 0.05 inch by using a needle loom in the process prior to bonding.

Binder formulations of the type described in the example below may be "airless sprayed" on a web of the type described above in two steps. The airlaid web is first conveyed into a spray booth. The liquid binder is then sprayed onto the top side of the web in a manner so as to apply the equivalent of 3.1 to 3.9 oz. per square yard of dry binder, and to penetrate at least half of the thickness of the web. The wet web is then conveyed into a drying oven, which is adjusted at a temperature sufficient to dry the binder and cause the latex component of the binder to form a film, but not high enough to effect crosslinking of the heat reactive latex present.

The web is then inverted, and its outer side is sprayed and dried in like manner. The finished, dry product should weight between 9.4 and 11.6 oz. per square yard.

EXAMPLE

The following binder formulation was prepared by mixing:

| Ingredient | Percent by Weight Present Wet | Dry |
|---|---|---|
| Water | 31.84 | — |
| Dispersing Agent (DIAMOND SHAMROCK Nopcosperse 44 - 33% Solids) | 0.39 | .13 |
| Wetting Agent (ROHM & HAAS TRITON × 100) | 0.41 | .41 |
| Attapulgite Clay (Thixotrope Agent-Englehardt Attagel 50) | 1.93 | 1.93 |
| Ammonia 26° Be | 0.09 | — |
| Wax Dispersion (50% Water Emulsion) | 2.19 | 1.10 |
| Antimony Trioxide (37% dispersion in water) | 2.7 | 1.00 |
| Dioctyl Phthalate (67% aqueous emulsion) | 2.0 | 1.34 |
| Pigment Dispersion (ferric oxide-50% aqueous emulsion) | 0.12 | .06 |
| B. F. Goodrich Geon 352 Latex (polyvinyl chloride-acrylate - 58% aqueous emulsion) | 15.37 | 8.9 |
| B. F. Goodrich Hycar 26084 (Styrenated acrylic self-crosslinking latex - 49% aqueous emulsion) | 21.13 | 10.35 |
| Thermoplastic Powder (Ingredient b) 100% solids | 21.83 | 21.83 |
| Total | 100.00 | 47.06 |

Three separate spray formulations were prepared using three different thermoplastic powders as Ingredient (b): for a first formulation, Griltex 4 P 1 by Emser Industries, a powdered mixture of nylon 6, 66, and 12; for a second formulation, Griltex 8 P 1, a linear copolyester powder (melt index 15-189/10 min. (ASTMD1238-2); melt pt. 110°-120° C.); and for a third formulation, Bostik 7178 by Emhart Chemical Group (melt index 619/10 min; melt pt. 121°-125° C.), a linear polyester powder.

In each of the above three binder formulations, the total solids present in an aqueous vehicle amounted to 47%. The viscosity of the formulation ranged from 50 to 100 cps at 50 rpm, measured with a Brookfield spindle No. 2.

The above formulations were applied to fibrous padding in the specific manner described above. The resulting dried fibrous paddings were placed between a cardboard backing and various fabric samples, and placed in an R.F. sealing apparatus, having a die which imposed parallel seal lines into the superimposed materials, in which the R.F. bonding process was in a temperature range of 275°-350° F. It was found that increases of up to about 80% in the peel strength resulted in bonds between the pads of this invention and uncoated knitted fabrics having an open chain stitch, when compared with corresponding latex bonded pads which did not include R.F. sealable thermoplastic powders in accordance with this invention. At the same time, peel strengths between non-woven fiber pads made as described herein and supported vinyl fabrics, and woven fabrics with latex adhesive thereon, were superior, commercially acceptable, and comparable with prior art products.

Furthermore, the non-woven fiber pads of this invention exhibited suitable flame resistance.

As an added advantage of the binder of this invention, the latex portion of the liquid binder facilitates the dispersing of the R.F. sealable plastic powders, which thus may be carried deeply into the fibrous padding by the latex vehicle. Upon drying, the latex vehicle also serves to bind the plastic powders into place so that they are not lost.

The mixture of plastic powders and latex residue in the dried fibrous padding provides improved heat bondability with a larger variety of fabrics than has been previously available, so that the fibrous padding of this invention is more versatile and useful in a wider variety of commercial situations. The binders of this invention may be used not only with polyester fiber pads but others such as polyamide, acrylic, modacrylic, polyolefin, and rayon.

The above has been offered for illustrative purposes only, and is not intended to limit the scope of the invention of this application, which is as defined in the claims below.

That which is claimed is:

1. In fibrous padding made of thermoplastic fibers and held together by a binder, the improvement comprising, in combination:

said binder comprising a mixture of (a) 25 to 100 parts by weight of an R.F. (radio frequency) sealable dried residue of a latex emulsion of a thermoplastic material primarily selected from the group consisting of polymers made from any of the monomers vinyl chloride, vinylidene chloride, vinyl acetate, ethylene, acrylic and methacrylic esters, and styrene; and (b) 25 to 100 parts by weight of an R.F. sealable thermoplastic powder selected from the group consisting of polyesters and polyamides which melt in a narrower temperature range than said latex emulsion residue.

2. The fibrous padding of claim 1 in which at least 6 weight percent of said dry binder is polyvinylchloride-acrylate latex emulsion residue, there being an amount of an oxide of antimony present sufficient to retard flammability.

3. The fibrous padding of claim 1 in which said latex emulsion residue is self-crosslinking at 275° to 350° F.

4. The fibrous padding of claim 1 in which said latex emulsion residue consists essentially of a mixture of 17 to 230 parts by weight of polyvinylchloride-acrylate and 100 parts by weight of styrenated acrylic self-crosslinking latex.

5. The fibrous padding of claim 1 in which 60 to 240 parts of dry latex emulsion residue are present per 100 parts of dry ingredient (b).

6. The fibrous padding of claim 1 in which said R.F. sealable thermoplastic powder is a polyamide reaction product of caprolactam, hexamethylenediamine adipate, and lauryl lactum.

7. The fibrous padding of claim 1 in which said R.F. sealable thermoplastic powder is polyester.

8. The fibrous padding of claim 1 in which said R.F. sealable thermoplastic powder has a particle size range of no more than 80 microns.

9. In non-woven fibrous padding made of thermoplastic fibers and held together by a binder, the improvement comprising in combination:

said binder comprising a mixture of (a) 25 to 100 parts by weight of an R.F. (radio frequency) sealable dried residue of a latex emulsion of a thermoplastic material primarily selected from the group consisting of polymers made from any of the monomers vinyl chloride, vinylidene chloride, vinyl acetate, ethylene, acrylic and methacrylic esters, and styrene; and (b) 25 to 100 parts by weight of an R.F. sealable thermoplastic powder selected from the group consisting of polyesters and polyamides which melt in a narrower temperature range than said latex emulsion residue, at least 6 weight percent of said binder being polyvinyl chloride-acrylate, there being an amount of antimony trioxide present sufficient to retard flammability, said latex emulsion residue being self-crosslinking at melting temperature.

10. The fibrous padding of claim 9 in which said latex emulsion residue consists essentially of a mixture of 17-230 parts by dry weight of polyvinyl chloride-acrylate and 100 parts by dry weight of a styrenated acrylic self-crosslinking latex.

11. The fibrous padding of claim 10 in which said R.F. sealable thermoplastic powder is a polyamide reaction product of caprolactam, hexamethylenediamine adipate and lauryl lactam.

12. The fibrous padding of claim 10 in which said R.F. sealable thermoplastic is polyester.

13. The fibrous padding of claim 10 in which said R.F. sealable thermoplastic powder has a particle size range of no more than 80 microns.

* * * * *